US010209678B2

(12) United States Patent
Zhao et al.

(10) Patent No.: US 10,209,678 B2
(45) Date of Patent: Feb. 19, 2019

(54) POINTER TYPE BLUETOOTH INTELLIGENTLY TIME-CORRECTED CLOCK MOVEMENT

(71) Applicant: Dongguan ZhunDian Plastic Electronics Co., Ltd., Dongguan (CN)

(72) Inventors: Xilei Zhao, Dongguan (CN); He Liu, Dongguan (CN); Changfeng Chen, Dongguan (CN)

(73) Assignee: DONGGUAN ZHUNDIAN PLASTIC ELECTRONICS CO., LTD. (CN)

( * ) Notice: Subject to any disclaimer, the term of this patent is extended or adjusted under 35 U.S.C. 154(b) by 0 days.

(21) Appl. No.: 15/685,528

(22) Filed: Aug. 24, 2017

(65) Prior Publication Data

US 2018/0164751 A1 Jun. 14, 2018

(30) Foreign Application Priority Data

Dec. 13, 2016 (CN) ..... 2016 1 1143307

(51) Int. Cl.
*G04G 21/02* (2010.01)
*G04R 20/26* (2013.01)
*G04R 40/06* (2013.01)

(52) U.S. Cl.
CPC ..... *G04R 20/26* (2013.01); *G04G 21/02* (2013.01); *G04R 40/06* (2013.01)

(58) Field of Classification Search
CPC .... G04B 37/0066; G04R 20/26; G04R 40/06; G04G 21/02
See application file for complete search history.

(56) References Cited

U.S. PATENT DOCUMENTS 9,594,354 B1 * 3/2017 Kahn ..... G04G 21/00
2006/0133213 A1 * 6/2006 Robert ..... G04G 21/02 368/11
2017/0300016 A1 * 10/2017 Lider ..... G04C 17/0091

* cited by examiner

*Primary Examiner* — Sean P Kayes
(74) *Attorney, Agent, or Firm* — S&L US IP Attorneys, P.C.; Eric Brandon Lovell; Timothy Marc Shropshire

(57) ABSTRACT

The invention discloses a pointer type Bluetooth intelligently time-corrected clock movement, comprising a movement body, wherein the bottom of the movement body is provided with a cell box, the surface of the cell box is provided with a disassembling hole, an hourly chiming module is provided at one side of the cell box, a central microprocessor is provided at one side of the hourly chiming module, a Bluetooth communication module is provided at one side of the central microprocessor, a power management circuit is provided at the other side of the cell box, and a display screen is provided at one end of the power management circuit. According to the invention, through an integrated technological application of "optics, electron, mechanical transmission and wireless communication", the control over a mechanical gear assembly is accomplished; through wirelessly receiving time information on an APP software and combining an operating principle of the central microprocessor controlling over a core plate and an optic-coupling device, a novel automatically time-corrected clock product is accomplished. The pointer type Bluetooth intelligently time-corrected clock movement is relatively practical, relatively high in precision, free of influences from factors of geography, signals and the like, and is suitable for broad promotion and use.

8 Claims, 2 Drawing Sheets

POINTER TYPE BLUETOOTH INTELLIGENTLY TIME-CORRECTED CLOCK MOVEMENT

CROSS REFERENCE TO RELATED APPLICATIONS

This application claims priority to the Chinese Patent Application CN201611143307.2, entitled "Pointer Type Bluetooth Intelligently Time-Corrected Clock Movement", filed at Dec. 13, 2016; the above-identified application is hereby incorporated by reference in its entirety as if fully set forth herein.

BACKGROUND

1. Technical Field

The invention relates to the field of clock movements, and more particularly, to a pointer type Bluetooth intelligently time-corrected clock movement.

2. Description of Related Art

There are the following several pointer type quartz clocks currently available on the market for automatically controlling time calibration.

1. A radio wave low-frequency amplitude modulation long-wave time service clock is referred to as a radio controlled clock for short. By receiving radio time service signals transmitted from National Time Service Centers (China BPC 68.5 KHZ, Japan JJY60 KHZ/40 kHZ; Germany DCF 77.5 KHZ; UK MSF 60 KHZ; Switzerland HBG 75 kHZ; US WWVB 60 kHZ) and using a microprocessor in the clock to control the clock to travel, the pointer display and the time in a place where the user is located are kept accurate. Although the regional area can receive a signal to perform time correction, the clock is convenient to use in a signal stable area, but represents the following shortcomings:

(1) Only one signal transmitting tower (currently only two transmitting towers in Japan) is available for each system of radio wave signal. Radio wave signals are likely to weaken under the actions of a transmission distance, terrain (e. g, obstruction of mountains), climate (e. g rain/snow weather), and environment (humid air, concrete construction), and electromagnetic noise generated when an electric appliance operates, resulting in signal instability and formation of dead angles of signals.

(2) Because of low carrier frequency and signal transmission rate, the efficiency is low and the time service process is time-consuming (3 to 8 minutes, BY up to 10 minutes).

(3) Similarly, because of low carrier frequency, which is close to or the same as the power frequency of a household appliance and industrial equipment used in daily life, the signal is extremely susceptible to interference from a signal having the same frequency to cause a poor signal, and ultimately cause signal reception failure.

(4) A single format of radio signals is limited in a coverage scope, which are only available for a particular country or region to perform time service, and cannot indicate the time of another region or country. In addition, radio frequencies and signal formats of different countries are different, resulting in different receiving circuits and signal decoding methods. If it is necessary to manufacture a movement compatible among multiple countries, a circuit thereof is complex and costly.

2. A GPS satellite time-service clock: time correction is performed by receiving GPS satellite signals in space, the signal coverage area is broad, almost to the global coverage, and the time service speed is fast (the time service can be accomplished generally in need of 15 to 40 seconds in an open environment), but there are more shortcomings:

(1) raw materials are costly to cause a direct result that the finished product is expensive and not conducive to promotion.

(2) A signal is present only in an outdoor environment, such that the clock is more suitable for use as an open-air square clock. The signal will be shielded once it enters indoors. In case of receiving signals at all times, it is necessary to set up a longer outdoor antenna, or signal forwarding equipment, resulting in increase of matched time service cost and high cost.

(3) Power consumption is high, which is only suitable for use in a commercial power supply environment. If cells are used to supply power, the cells are required to charge frequently and thus inconvenient to use. It is not conducive to making a portable product powered by cells for a long time.

(4) The time zone needs to be set manually, and because what the GPS satellite sends is UTC time, the correct user's local time can be displayed after the correct time zone is set. There are also individual models that have joined the automatic time zone, but because the actual time zones of countries around the world are not divided entirely in accordance with the coordinates, there is often a phenomenon of wrong judgment in some time zones, so it is necessary to add an action of setting the time zone manually, resulting in inconvenience of use. In order to remedy and solve the above-mentioned defects and shortcomings in various automatically time-corrected clocks, we propose a pointer type Bluetooth intelligently time-corrected clock movement.

SUMMARY

Aiming at the shortcomings above in existing technology, the invention is to provide a pointer type Bluetooth intelligently time-corrected clock movement. Through an integrated technological application of "optics, electron, mechanical transmission and wireless communication", the control over a mechanical gear assembly is accomplished; through wirelessly receiving time information on an APP software and combining an operating principle of the central microprocessor controlling over a core plate and an optic-coupling device, a novel automatically time-corrected clock product is accomplished. The pointer type Bluetooth intelligently time-corrected clock movement is relatively practical, relatively high in precision, free of influences from factors of geography, signals and the like, and is capable of effectively solving the problems in the background.

To achieve the purpose, the present invention adopts the following technical solutions:

a pointer type Bluetooth intelligently time-corrected clock movement comprises a movement body, wherein the bottom of the movement body is provided with a cell box; the surface of the cell box is provided with a disassembling hole; an hourly chiming module is provided at one side of the cell box; a central microprocessor is provided at one side of the hourly chiming module; a Bluetooth communication module is provided at one side of the central microprocessor; a power management circuit is provided at the other side of the cell box; a display screen is provided at one end of the power management circuit; a sensor module is provided at one side of the display screen; a fastening screw hole is formed in one side of the sensor module; a gear assembly is provided at one side of the Blue communication module; an optic-coupling sensor is provided at one side of the gear assembly; an environment monitoring module is provided at one side of the optic-coupling sensor; a stepping motor is provided at the bottom of the gear assembly; a key switch is provided at the other side of the Bluetooth communication module.

Further, a cell pack is provided inside the cell box; the cell pack is a 1.5-4.5V cell power supply formed by connecting one to three 1.5V cells in series, and each 1.5V cell has a movement dimension of 56 mm×56 mm.

Further, the cell box, the hourly chiming module, the central microprocessor, the Bluetooth communication module, the power management circuit, the display screen, the sensor module and the stepping motor are electrically connected with the key switch.

Further, the Bluetooth communication module makes use of a Bluetooth communication technology of 4.0 and above (BLE).

Further, the sensor module comprises a harmful gas sensor (such as volatile gases, such as formaldehyde, carbon monoxide and nitrocellulose lacquer thinner), an inflammable gas sensor (coal gas, natural gas, liquefied petroleum gas and other inflammable gases), a smoke sensor and a temperature sensor.

Compared with the prior art, the present invention has the following beneficial effects: upon the combination of the movement body, the cell box and the disassembling hole, the cell pack is provided inside the cell box, the cell pack is a 1.5-4.5V cell power supply formed by connecting one to three 1.5V cells in series, and each 1.5V cell has a movement dimension of 56 mm×56 mm; the cell pack consisting of small cells is long in service life and relatively durable, and can reduce the volume of the movement body and improve the aesthetic extent of the clock. The movement body can be assembled and dissembled conveniently via the disassembling hole. Upon the combination of the hourly chiming module, the central microprocessor, the Bluetooth communication module, the power management circuit and the display screen and the connection of the hourly chiming module and the cell pack via the power management circuit, time data can be processed by the central microprocessor, a reminder is made in hourly moments to facilitate user's use and increase the user's sense of time. The Bluetooth communication module can receive signals. Upon the combination of the display screen, the sensor module and the fastening screw hole, the sensor module including a formaldehyde sensor, a smoke sensor and a temperature sensor can transmit signals generated from the sensors to the display screen for a timely understanding of the user, thereby being more convenient and practical. The sensor module can be assembled and dissembled conveniently via the fastening screw hole. Upon the combination of the optic-coupling sensor, the key switch, the gear assembly, the stepping motor and the environment monitoring module, the cell box, the hourly chiming module, the central microprocessor, the Bluetooth communication module, the power management circuit, the display screen, the sensor module and the stepping motor are electrically connected with the key switch. The Bluetooth communication module makes use of a Bluetooth communication technology of 4.0 and above (BLE). The Bluetooth communication module and the central microprocessor are adopted to control the movement to keep travel-time according to internal programming at ordinary times. The Bluetooth module receives update information and then transmits the update information to the central microprocessor, the central microprocessor converts the read information into an electric signal according to new time information demodulation to drive the stepping motor to drive the gear assembly. The gear assembly regulates the time indicated by a pointer to operate. The optic-coupling sensor is configured to detect whether the gear assembly has a location deviation and correct a mechanical deviation of the current gear assembly, thereby realizing accurate travel-time of the gear assembly, and being convenient and higher in accuracy. According to the pointer type Bluetooth intelligently time-corrected clock movement disclosed by the present invention, through an integrated technological application of "optics, electron, mechanical transmission and wireless communication", the control over a mechanical gear assembly is accomplished; through wirelessly receiving time information on an APP software and combining an operating principle of the central microprocessor controlling over a core plate and an optic-coupling device, a novel automatically time-corrected clock product is accomplished. The pointer type Bluetooth intelligently time-corrected clock movement is relatively practical, relatively high in precision, free of influences from factors of geography, signals and the like, and is suitable for broad promotion and use.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments.

Reference number in drawings are as follows in sequence:

1 movement body; 2 cell box; 3 disassembling hole; 4 hourly chiming module; 5 central microprocessor; 6 Bluetooth communication module; 7 power management circuit; 8 display screen; 9 sensor module; 10 fastening screw hole; 11 optic-coupling sensor; 12 key switch; 13 gear assembly; 14 stepping motor; 15 environment monitoring module.

DETAILED DESCRIPTION

The present invention will be further described in detail as below in conjunction with the drawings and the embodiments, in order to make the objective, the technical solution and the advantages of the present invention understand more clearly. It should be understood that the specific embodiments described here are merely used for explaining the present invention, rather than limiting the present invention.

Figure 1:
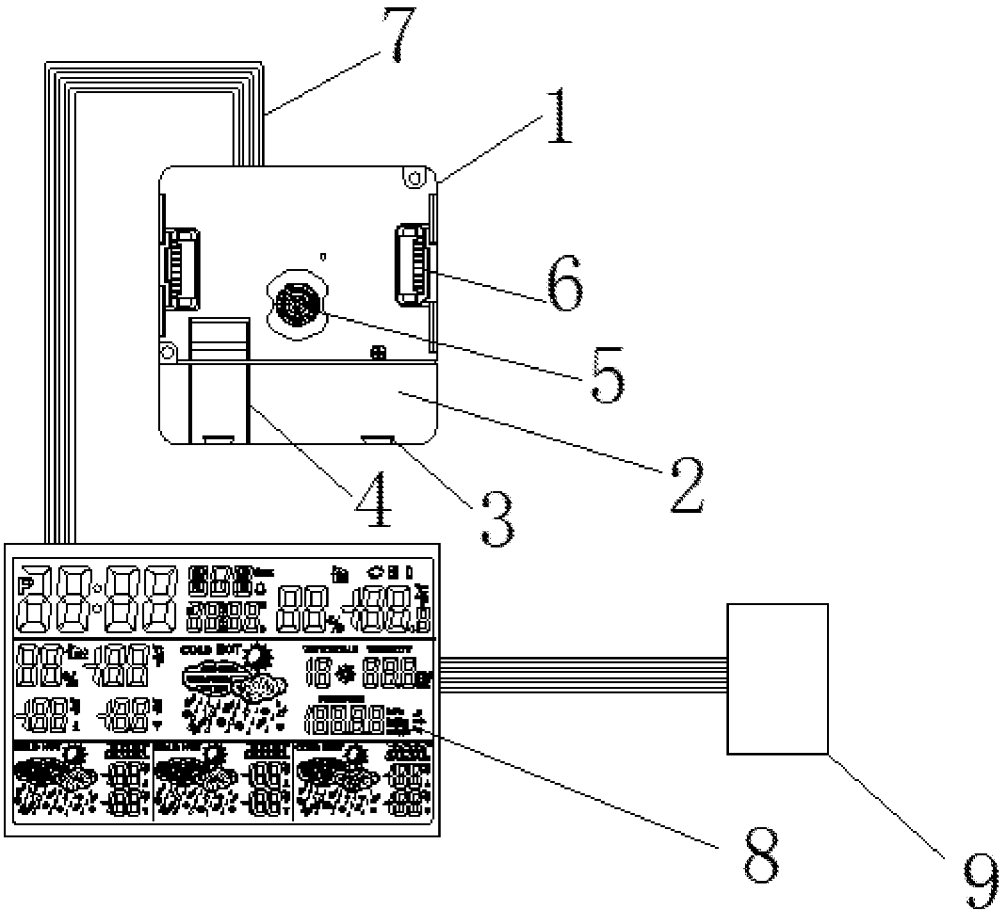
FIG. 1 is a schematic view showing the overall structure of a pointer-type Bluetooth intelligently time-corrected clock.
Figure 2:
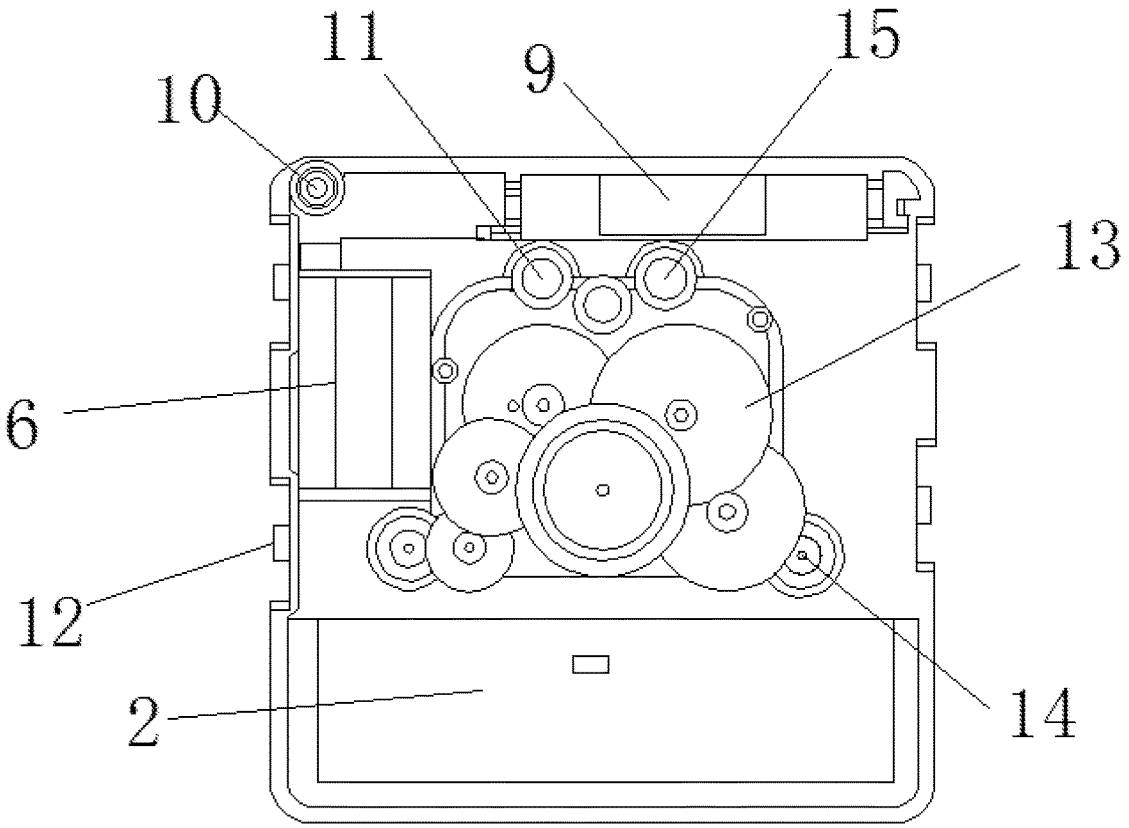
FIG. 2 is a schematic view showing the local structure of the pointer-type Bluetooth intelligently time-corrected clock.

As shown in FIGS. 1-2, a pointer type Bluetooth intelligently time-corrected clock movement comprises a movement body 1, wherein the bottom of the movement body 1 is provided with a cell box 2; the surface of the cell box 2 is provided with a disassembling hole 3; an hourly chiming module 4 is provided at one side of the cell box 2; a central microprocessor 5 is provided at one side of the hourly chiming module 4; a Bluetooth communication module 6 is provided at one side of the central microprocessor 5; a power management circuit 7 is provided at the other side of the cell box 2; a display screen 8 is provided at one end of the power management circuit 7; a sensor module 9 is provided at one side of the display screen 8; a fastening screw hole 10 is formed in one side of the sensor module 9; a gear assembly 13 is provided at one side of the Blue communication module 6; an optic-coupling sensor 11 is provided at one side of the gear assembly 13; an environment monitoring module 15 is provided at one side of the optic-coupling sensor 11; a stepping motor 14 is provided at the bottom of the gear assembly 13; a key switch 12 is provided at the other side of the Bluetooth communication module 6.

According to the pointer type Bluetooth intelligently time-corrected clock movement disclosed by the present invention, upon the combination of the movement body 1, the cell box 2 and the disassembling hole 3, the cell pack is provided inside the cell box 2, the cell pack is a 1.5-4.5V cell power supply formed by connecting one to three 1.5V cells in series, and each 1.5V cell has a movement dimension of 56 mm×56 mm; the cell pack consisting of small cells is long in service life and relatively durable, and can reduce the volume of the movement body 1 and improve the aesthetic extent of the clock. The movement body 1 can be assembled and dissembled conveniently via the disassembling hole 3. Upon the combination of the hourly chiming module 4, the central microprocessor 5, the Bluetooth communication module 6, the power management circuit 7 and the display screen 8 and the connection of the hourly chiming module 4 and the cell pack via the power management circuit 7, time data can be processed by the central microprocessor 5, and a reminder is made in hourly moments to facilitate user's use and increase the user's sense of time. The Bluetooth communication module 6 can receive signals. Upon the combination of the display screen 8, the sensor module 9 and the fastening screw hole 10, the sensor module 9 including a formaldehyde sensor, a smoke sensor and a temperature sensor can transmit signals generated from the sensors to the display screen 8 for a timely understanding of the user, thereby being more convenient and practical. The sensor module 9 can be assembled and dissembled conveniently via the fastening screw hole 10. Upon the combination of the optic-coupling sensor 11, the key switch 12, the gear assembly 13, the stepping motor 14 and the environment monitoring module 15, the cell box 2, the hourly chiming module 4, the central microprocessor 5, the Bluetooth communication module 6, the power management circuit 7, the display screen 8, the sensor module 9 and the stepping motor 14 are electrically connected with the key switch 12. The Bluetooth communication module 6 makes use of a Bluetooth communication technology of 4.0 and above (BLE). The Bluetooth communication module 6 and the central microprocessor 5 are adopted to control the movement to keep travel-time according to internal programming at ordinary times. The Bluetooth module receives update information and then transmits the update information to the central microprocessor 5, the central microprocessor 5 converts the read information into an electric signal according to new time information demodulation to drive the stepping motor 14 to drive the gear assembly 13. The gear assembly 13 regulates the time indicated by a pointer to operate. The optic-coupling sensor 11 is configured to detect whether the gear assembly 13 has a location deviation and correct a mechanical deviation of the current gear assembly 13, thereby realizing accurate travel-time of the gear assembly 13, and being convenient and higher in accuracy. According to the pointer type Bluetooth intelligently time-corrected clock movement disclosed by the present invention, through an integrated technological application of 'optics, electron, mechanical transmission and wireless communication', the control over a mechanical gear component is accomplished; through wireless receiving of time information on an APP software, combining an operating principle of the central microprocessor controlling over a core plate and an optic-coupling device, a novel automatically time-corrected clock product is accomplished. The pointer type Bluetooth intelligently time-corrected clock movement is relatively practical, relatively high in precision, free of influences from factors of geography, signals and the like, and is suitable for board promotion and use.

A cell pack is provided inside the cell box 2; the cell pack is a 1.5-4.5V cell power supply formed by connecting one to three 1.5V cells in series, and each 1.5V cell has a movement dimension of 56 mm×56 mm.

The cell box 2, the hourly chiming module 4, the central microprocessor 5, the Bluetooth communication module 6, the power management circuit 7, the display screen 8, the sensor module 9 and the stepping motor 14 are electrically connected with the key switch 12.

The Bluetooth communication module 6 makes use of a Bluetooth communication technology of 4.0 and above (BLE).

The sensor module 9 comprises a harmful gas sensor (such as volatile gases, such as formaldehyde, carbon monoxide and nitrocellulose lacquer thinner, and other harmful gases), an inflammable gas sensor (coal gas, natural gas, liquefied petroleum gas and other inflammable gases), a smoke sensor and a temperature sensor.

It should be noted that: the sensor module uses a gas-sensitive semiconductor as a sensitive material, which causes changes in carrier concentration or distribution inside the semiconductor material under the action of a variety of physical quantities, thereby resulting in changes in electrical signals. The concentration and content parameters of the measured gas can be reflected by the changes in these physical properties. By the use of the characteristics that the wave velocity and frequency of the sensor module will drift with the changes in the external environment, information regarding the type of gas and its concentration will be converted into electrical signals. Depending on the intensity of these electrical signals, information on the presence of the gas to be measured in the environment can be obtained. When the sensor interacts with the gas to be measured (chemical or biological action, or physical adsorption), the conductivity of the sensor changes, thereby causing the drift of a surface acoustic wave frequency of a piezoelectric crystal. Due to different gas concentrations and different film qualities and conductivity changes, changes in the surface acoustic wave frequency are also different. By measuring the change in frequency of the sensor, the exact change value reflecting the concentration of the gas can be obtained. Therefore, detection, monitoring and alarming can be performed. An interface circuit and the central microprocessor constitute a detection, control and alarming system.

When the sensor module contacts harmful molecules or smoke, such as hydrogen, carbon monoxide, formaldehyde, alkane, ether, benzene and natural gas, a reduction reaction will occur to release heat, so that the component temperature increases correspondingly, and the resistance changes. Therefore, the detection of carbon monoxide gas, mash gas, coal gas detection, ethanol and the like can be realized. By the use of feature of the semiconductor material, the gas composition and concentration are converted into electrical signals for monitoring and alarm.

The foregoing descriptions of the embodiments and their accompanying drawings of the invention are intended to illustrate and not to limit this invention. Various changes and modifications may be made to the embodiments without departing from the spirit of the invention. Therefore, the scope of the invention is to be limited only by the appended claims.

We claim:

1. A pointer type, wirelessly-enabled, intelligently time-corrected clock movement, comprising:

a) a movement body including a cell box disposed at a bottom of the movement body, wherein a surface of the cell box includes a disassembling hole, and wherein a cell pack is provided inside the cell box, wherein the cell pack is a 1.5-4.5V cell power supply formed by connecting one to three 1.5V cells in series, wherein each 1.5V cell has a movement dimension of 56 mm×56 mm;

b) an hourly chiming module disposed at a bottom of the cell box;

c) a microprocessor centrally disposed within the movement body;

d) a wireless communication module disposed at a right side of the movement body;

e) a power management circuit having a first end extending from a top of the movement body;

f) a display screen electrically connected to a second end of the power management circuit;

g) a sensor module electrically connected to the display screen;

h) a fastening screw hole disposed through a top right hand corner of the movement body;

i) a gear assembly centrally disposed within the movement body;

j) an optic-coupling sensor disposed above the gear assembly;

k) an environment monitoring module disposed above the gear assembly and adjacent to the optic-coupling sensor;

l) a stepping motor disposed at the bottom of the gear assembly; and m) a key switch disposed at the right side of the movement body and below the wireless communication module.

2. The clock movement of claim 1, wherein the cell box, the hourly chiming module, the central microprocessor, the wireless communication module, the power management circuit, the display screen, the sensor module and the stepping motor are electrically connected with the key switch.

3. The clock movement of claim 1, wherein the wireless communication module makes use of a wireless communication technology of 4.0 and above (BLE).

4. The clock movement of claim 1, wherein the sensor module comprises a harmful gas sensor, an inflammable gas sensor, a smoke sensor and a temperature sensor.

5. The clock movement of claim 4, wherein the gas sensor detects a presence of volatile gases.

6. The clock movement of claim 5, wherein the volatile gases are selected from the group consisting of formaldehyde, carbon monoxide, and nitrocellulose lacquer thinner.

7. The clock movement of claim 4, wherein the inflammable gas sensor detects a presence of inflammable gases.

8. The clock movement of claim 7, wherein the inflammable gases are selected from the group consisting of coal gas, natural gas, and liquefied petroleum gas.

* * * * *